US008944563B2

(12) United States Patent
Takayanagi

(10) Patent No.: US 8,944,563 B2
(45) Date of Patent: Feb. 3, 2015

(54) RECORDING APPARATUS

(71) Applicant: Seiko Epson Corporation, Tokyo (JP)

(72) Inventor: Ryota Takayanagi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 13/727,931

(22) Filed: Dec. 27, 2012

(65) Prior Publication Data

US 2013/0169712 A1 Jul. 4, 2013

(30) Foreign Application Priority Data

Dec. 28, 2011 (JP) ..... 2011-287760

(51) Int. Cl.
*B41J 23/00* (2006.01)
*B41J 25/00* (2006.01)

(52) U.S. Cl.
CPC ..... *B41J 25/001* (2013.01)
USPC ..... 347/39; 347/37

(58) Field of Classification Search
CPC ... B41J 25/308; B41J 25/3082; B41J 25/3088
See application file for complete search history.

(56) References Cited

FOREIGN PATENT DOCUMENTS

JP 2011-051272 A 3/2011

*Primary Examiner* — Justin Seo
(74) *Attorney, Agent, or Firm* — Nutter McClennen & Fish LLP; John J. Penny, Jr.

(57) ABSTRACT

A recording apparatus includes an ejecting head that ejects fluid onto a recording medium, and a head moving portion that makes the ejecting head reciprocate in a first direction. In the recording apparatus, the head moving portion includes a guide shaft which is arranged along the first direction, a first carriage which is supported on the guide shaft, and moves in the first direction along the guide shaft, and a second carriage which is provided integrally with the ejecting head, is provided so as to be movable in a second direction in which a distance between the ejecting head and the recording medium is changed between the first carriage and the second carriage, and is positioned in a state where a part of the second carriage is abutted against the guide shaft such that inclination of the ejecting head with respect to the first direction is restricted.

6 Claims, 7 Drawing Sheets

RECORDING APPARATUS

BACKGROUND

1. Technical Field

The present invention relates to a recording apparatus.

2. Related Art

An ink jet printer has been known as one of recording apparatuses which eject fluid onto a recording medium and record images, characters, and the like. There is an ink jet printer having a configuration in which a distance (hereinafter, referred to as paper gap) between the head surface of an ejecting head which discharges ink and a recording medium can be adjusted.

As the configuration in which the paper gap is adjusted, the following configuration example is included. For example, a configuration in which the ejecting head is mounted on a carriage and the carriage reciprocates in a predetermined scanning direction by a guide shaft, and the guide shaft is made to go up and down has been known. Further, for example, as described in JP-A-2011-51272, a configuration in which the carriage is made to have a two-body structure including a first carriage (main carriage) and a second carriage (sub carriage) and the sub carriage is displaced relative to the main carriage so as to adjust the paper gap has been known.

However, in the configuration as described in JP-A-2011-51272, the number of parts from the guide shaft to the ejecting head is large and desired attachment accuracy cannot be obtained in some cases. In this case, the ejecting head is made into a state of being inclined with respect to the guide shaft. Therefore, an adjusting mechanism of adjusting the inclination of the ejecting head, or the like, is required to be provided separately for adjusting the attachment accuracy. As a result, cost is increased due to increase in the number of parts and increase in assembling time.

SUMMARY

An advantage of some aspects of the invention is to provide a recording apparatus which can be reduced in cost.

A recording apparatus according to an aspect of the invention includes an ejecting head that ejects fluid onto a recording medium, and a head moving portion that makes the ejecting head reciprocate in a first direction. In the recording apparatus, the head moving portion includes a guide shaft which is arranged along the first direction, a first carriage which is supported on the guide shaft, and moves in the first direction along the guide shaft, and a second carriage, which is provided integrally with the ejecting head, is connected to the first carriage, is provided so as to be movable in a second direction in which a distance between the ejecting head and the recording medium is changed between the first carriage and the second carriage, and is positioned in a state where a part of the second carriage is abutted against the guide shaft such that inclination of the ejecting head with respect to the first direction is restricted.

According to the aspect of the invention, the second carriage is provided integrally with the ejecting head, is connected to the first carriage, is provided so as to be movable in the second direction in which the distance between the ejecting head and the recording medium is changed between the first carriage and the second carriage, and is positioned in a state where a part of the second carriage is abutted against the guide shaft such that the inclination of the ejecting head with respect to the first direction is restricted. Therefore, the inclination of the ejecting head with respect to the first direction can be restricted without providing an adjusting mechanism which adjusts the inclination of the ejecting head. Accordingly, the number of parts from the guide shaft to the ejecting head can be reduced and positional accuracy of the ejecting head can be ensured. Therefore, assembling time can be reduced. This makes it possible to reduce in cost.

In the recording apparatus according to the aspect of the invention, it is preferable that the head moving portion have a second guide shaft which is arranged so as to be spaced from the guide shaft and guides the reciprocation of the ejecting head in the first direction.

According to the aspect of the invention, the head moving portion has the second guide shaft which is arranged so as to be spaced from the guide shaft and guides the reciprocation of the ejecting head in the first direction. Therefore, the ejecting head can be supported on a surface by these two guide shafts. Accordingly, the ejecting head can be prevented from moving in a rotating direction about the guide shaft.

In the recording apparatus according to the aspect of the invention, it is preferable that the second carriage be positioned in a state where a part of the second carriage is abutted against the second guide shaft.

According to the aspect of the invention, the second carriage is positioned in a state where a part of the second carriage is abutted against the second guide shaft. Therefore, the ejecting head can be prevented from moving in a rotating direction about the guide shaft.

In the recording apparatus according to the aspect of the invention, it is preferable that the first carriage be supported on the second guide shaft.

According to the aspect of the invention, the first carriage is supported on the second guide shaft. Therefore, the ejecting head can be prevented from moving in a rotating direction about the guide shaft.

In the recording apparatus according to the aspect of the invention, it is preferable that the head moving portion have an elastic member that provides an elastic force in the second direction acting on the first carriage and the second carriage.

According to the aspect of the invention, the head moving portion has the elastic member that produces an elastic force in the second direction acting on the first carriage and the second carriage. Therefore, adjustment of a relative position between the first carriage and the second carriage in the second direction can be performed flexibly.

In the recording apparatus according to the aspect of the invention, it is preferable that the second carriage be abutted against the guide shaft at at least two places.

According to the aspect of the invention, the second carriage are abutted against the guide shaft at at least two places. Therefore, the ejecting head can be prevented from moving in the direction of being inclined with respect to the first direction more reliably.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
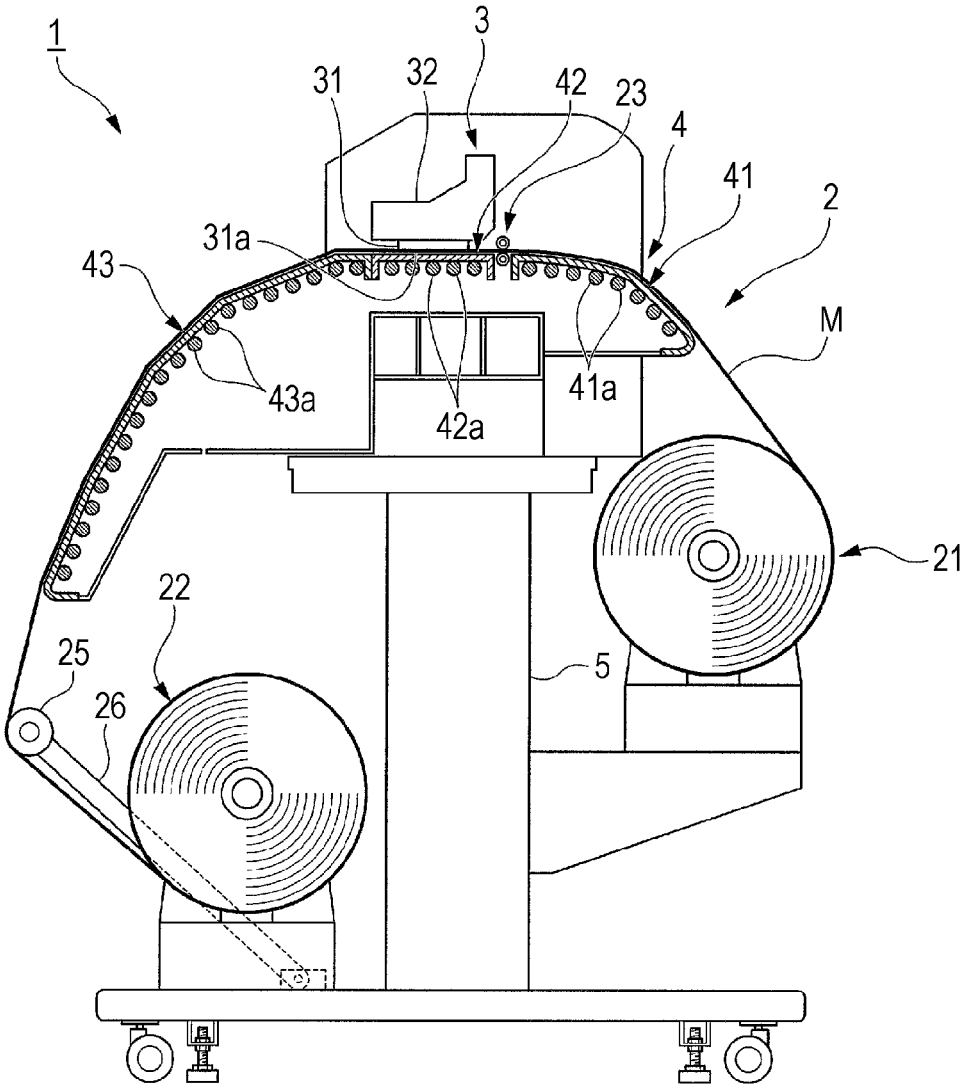
FIG. 1 is a view illustrating a configuration of a printer according to an embodiment of the invention.

Hereinafter, embodiments of a recording apparatus according to the invention are described with reference to the drawings. In the drawings to be used in the following description, scales of members are changed appropriately for making the members have sizes which can be recognized. In the embodiment, an ink jet printer (hereinafter, simply referred to as printer) is described as an example of the recording apparatus according to the invention.

FIG. 1 is an example illustrating a configuration of a printer 1 in the embodiment of the invention.

The printer 1 is a large format printer (LFP) in which a relatively large-sized medium (recording medium) M is used. The medium M in the embodiment is formed by a vinyl chloride-based film.

As illustrated in FIG. 1, the printer 1 includes a transportation portion 2, a recording portion 3, and a heating portion 4. The transportation portion 2 transports the medium M with a roll-to-roll system. The recording portion 3 ejects ink (fluid) onto the medium M and records images, characters, and the like thereon. The heating portion 4 heats the medium M. These constituent components are supported by a main body frame 5.

The transportation portion 2 includes a roller 21 and a roller 22. The roller 21 feeds out the medium M in a roll form. The roller 22 rolls up the medium M which has been fed out. The transportation portion 2 includes a transportation roller pair 23 which transports the medium M on a transportation path between the roller 21 and the roller 22. Further, the transportation portion 2 includes a tension roller 25 which applies a tensile force to the medium M. The tension roller 25 is supported by a swinging frame 26.

The recording portion 3 includes an ink jet head (ejecting head) 31 and a head moving portion 32. The ink jet head 31 ejects ink onto the medium M to be transported. The ink jet head 31 is mounted on the head moving portion 32. The head moving portion 32 is reciprocable in the width direction (direction perpendicular to a paper plane in FIG. 1, hereinafter, referred to as first direction). The ink jet head 31 includes a plurality of nozzles and can eject ink which requires penetration drying or evaporation drying which is selected based on a relationship with the medium M. The ink jet head 31 in the embodiment is configured to be capable of ejecting solvent-based ink and aqueous ink which require the evaporation drying.

The heating portion 4 is configured to dry ink and fix the ink onto the medium quickly by heating the medium M so as to prevent bleeding and blur of the ink and enhance image quality. The heating portion 4 includes a preheater portion 41, a platen heater portion 42, and an after-heater portion 43. The preheater portion 41 preheats the medium M at the upstream side in the transportation direction relative to a position at which the recording portion 3 is provided. The platen heater portion 42 heats the medium M at a position opposed to the recording portion 3. The after-heater portion 43 heats the medium M at the downstream side in the transportation direction relative to the position at which the recording portion 3 is provided.

Figure 2:
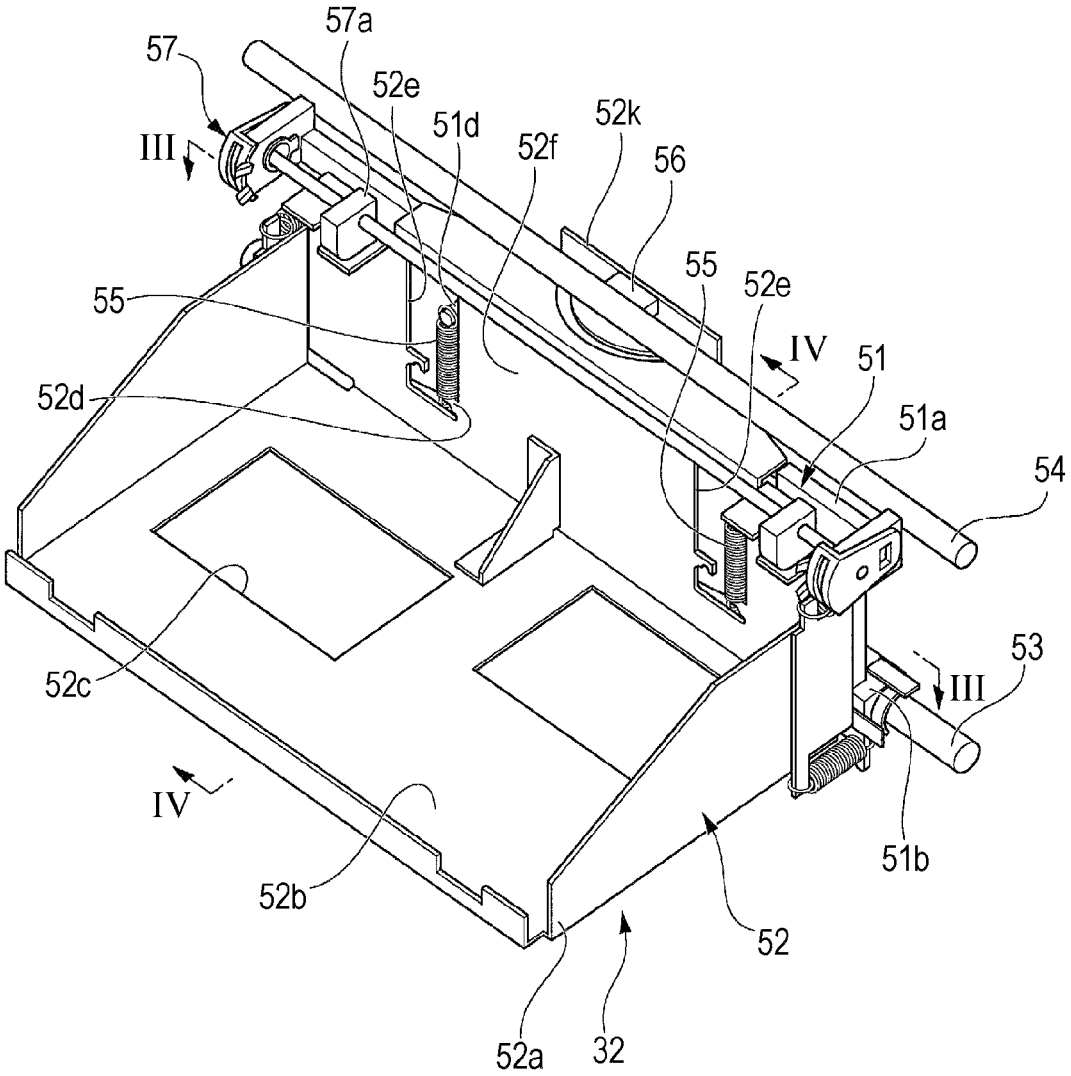
FIG. 2 is a perspective view illustrating a configuration of a carriage according to the embodiment.
Figure 3:
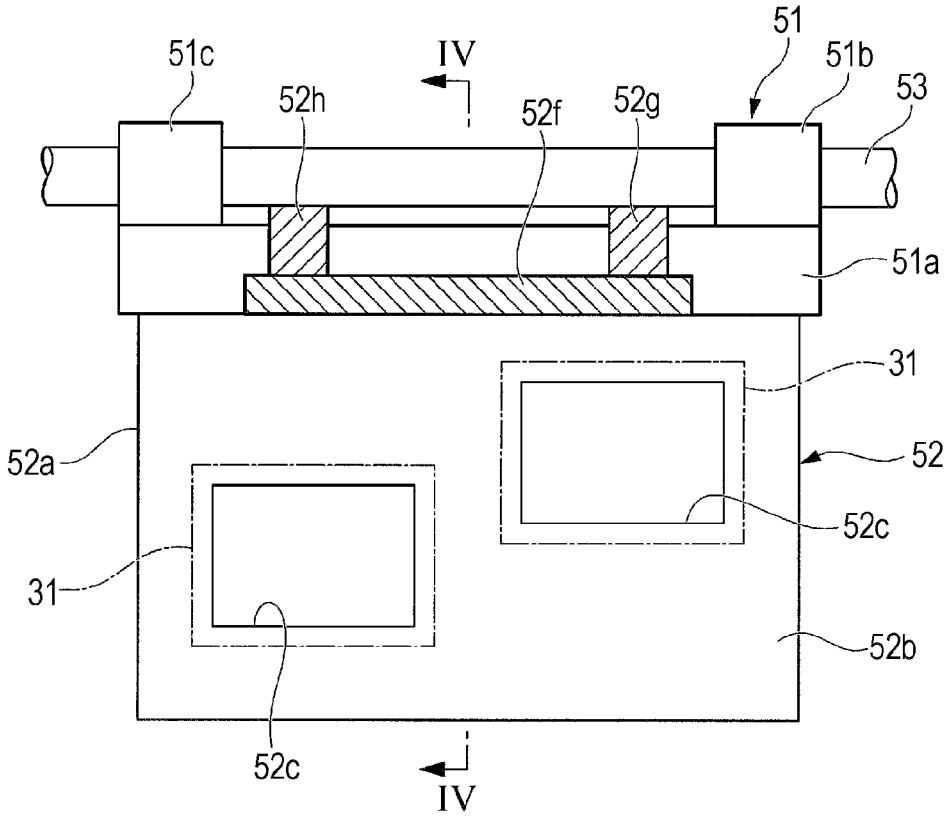
FIG. 3 is a cross-sectional view illustrating the configuration of the carriage according to the embodiment.
Figure 4:
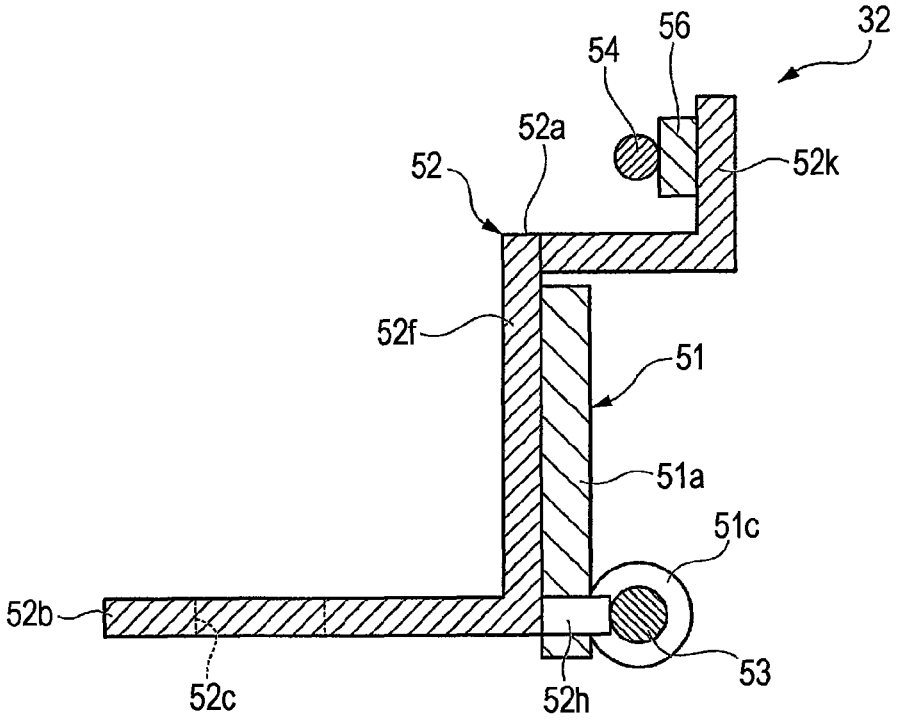
FIG. 4 is a cross-sectional view illustrating the configuration of the carriage according to the embodiment.

FIG. 2 is a perspective view illustrating a configuration of the head moving portion 32. FIG. 3 is a view illustrating a configuration along a cross section cut along a line III-III in FIG. 2. FIG. 4 is a view illustrating a configuration along a cross section cut along a line IV-IV in FIG. 2. It is to be noted that in FIG. 3, a position corresponding to the cross section cut along the line IV-IV in FIG. 2 is illustrated.

As illustrated in FIG. 2 to FIG. 4, the head moving portion 32 includes a first carriage 51, a second carriage 52, a first guide shaft 53, and a second guide shaft 54. Each of the first guide shaft 53 and the second guide shaft 54 is formed in a columnar shape and they are arranged in parallel in the first direction. The first guide shaft 53 and the second guide shaft 54 are supported by wall portions (not illustrated) and the like.

The first carriage 51 includes a base member 51*a*. The base member 51*a* is formed in a plate form by using a material having high rigidity, such as a metal, for example. The base member 51*a* is arranged to be vertical to the transportation direction of the medium M. The base member 51*a* is connected to a driving mechanism (not illustrated) and is provided so as to be movable in the first direction by the driving mechanism.

A bearing portion 51*b* and a bearing portion 51*c* are provided on the base member 51*a*. The bearing portion 51*b* and the bearing portion 51*c* are provided on end portions of the base member 51*a* in the first direction. The base member 51*a* is supported on the first guide shaft 53 at two places of the bearing portion 51*b* and the bearing portion 51*c*. With this, inclination of the base member 51*a* with respect to the first guide shaft 53 is suppressed.

The bearing portion 51*b* and the bearing portion 51*c* are formed so as to surround the outer circumferential surface of the first guide shaft 53 by substantially one round. The bearing portion 51*b* and the bearing portion 51*c* are formed so as to slide between the outer circumferential surface of the first guide shaft 53 and the bearing portions 51*b* and 51*c*. Therefore, the base member 51*a* is movable in the first direction in a state of being supported on the first guide shaft 53 by the bearing portions 51*b* and 51*c*.

The second carriage 52 has a head holding member 52*a*. The head holding member 52*a* is formed into a box shape by using a material having high rigidity, such as a metal, for example. The head holding member 52*a* is formed by a method such as a cutting processing, for example. The head holding member 52*a* is formed into a shape including a plurality of surfaces including a bottom portion 52*b*, a wall portion 52*f*, and the like, which intersect with one another. The bottom portion 52*b* is arranged to be parallel with the transportation surface of the medium M. The wall portion 52*f* is arranged to be parallel with the direction (second direction) vertical to the transportation surface of the medium M. Therefore, the head holding member 52*a* is configured so as not to be deformed easily even if receiving a weight of the head holding member 52*a* itself and a weight of the ink jet head 31.

Openings 52*c* are formed on the bottom portion 52*b* of the head holding member 52*a*. The ink jet head 31 is fitted into the opening 52*c*. In the embodiment, a configuration in which two openings 52*c* are arranged is described, for example. However, the invention is not limited to the configuration and a configuration in which one or more than or equal to three openings 52*c* are formed may be employed.

The wall portion 52*f* of the head holding member 52*a* is attached to the base member 51*a* of the first carriage 51. The wall portion 52*f* is arranged so as to be opposed to the base member 51*a*. A plurality of openings 52*e* are formed on the wall portion 52*f*. Protrusions 51*d* formed on the base member 51*a* of the first carriage 51 are exposed on the openings 52*e*. Further, protrusions 52*d* are formed on edge portions of the openings 52*e* on the wall portion 52*f*.

Moreover, an abutting portion 52*g* and an abutting portion 52*h* are provided on the wall portion 52*f*. Each of the abutting portion 52*g* and the abutting portion 52*h* is abutted against the first guide shaft 53. The abutting portion 52*g* and the abutting portion 52*h* are arranged at a predetermined interval in the first direction. The abutting portion 52*g* and the abutting portion 52*h* are formed so as to project to the first guide shaft 53 from the wall portion 52*f*. Further, the abutting portion 52*g* and the abutting portion 52*h* are formed to have the same dimension in the protruding direction. In addition, surfaces of the abutting portion 52*g* and the abutting portion 52*h*, which are abutted against the first guide shaft 53, are formed to be flattened surfaces.

The wall portion 52*f* is arranged to be parallel with the first guide shaft 53 in a state where the abutting portion 52*g* and the abutting portion 52*h* are abutted against the first guide shaft 53 at two places. Therefore, the ink jet head 31 to be attached to the bottom portion 52*b* is positioned so as not to be inclined to the side of the transportation direction of the medium M with respect to the first direction.

A bending portion 52*k* is provided on the wall portion 52*f*. The bending portion 52*k* is formed such that a lengthwise direction thereof corresponds to the first direction. For example, as illustrated in FIG. 4, the bending portion 52*k* is formed such that a cross section thereof has an L shape. To be more specific, the bending portion 52*k* is formed so as to wind around the second guide shaft 54 to the upstream side in the transportation direction of the medium M. The bending portion 52*k* has a second abutting portion 56.

The second abutting portion 56 is arranged so as to be abutted against the second guide shaft 54 from the upstream side in the transportation direction of the medium M. To be more specific, the second abutting portion 56 is arranged between the second guide shaft 54 and the bending portion 52*k*. The second abutting portion 56 is abutted against the second guide shaft 54 so that deviation of the second carriage 52 in the transportation direction of the medium M is restricted.

The second abutting portion 56 is formed into a rectangular columnar shape such that a lengthwise direction thereof corresponds to the first direction. A portion of the second abutting portion 56, which is abutted against the second guide shaft 54, is formed to be a flattened surface. Therefore, a portion of the second abutting portion 56, which is continuous in the first direction, is abutted against the second guide shaft 54 so that deviation of the second abutting portion 56 to the side of the transportation direction of the medium M with respect to the first direction is restricted.

A gap adjusting portion 57 is provided on the wall portion 52*f*. The gap adjusting portion 57 has cam mechanisms 57*a*, for example. The gap adjusting portion 57 makes the second carriage 52 go up and down relative to the first carriage 51 with the cam mechanisms 57*a* so as to adjust the distance (paper gap) between the head surface 31*a* (see, FIG. 1) of the ink jet head 31 and the medium M.

The protrusions 51*d* and the protrusions 52*d* are connected to each other by elastic members 55. As the elastic members 55, for example, elastic members such as springs are used. The elastic members 55 produces elastic forces in the second direction acting on the protrusions 51*d* and the protrusions 52*d*. The elastic force in the second direction acts on the first carriage 51 and the second carriage 52 by the elastic members 55. Therefore, the adjustment of the distance between the first carriage 51 and the second carriage 52 in the second direction by the gap adjusting portion 57 is performed flexibly.

As described above, in the printer 1 according to the embodiment, the second carriage 52 is provided integrally with the ink jet head 31, is connected to the first carriage 51, and is provided so as to be movable in the second direction in which the distance between the ink jet head 31 and the medium M is changed between the second carriage 52 and the first carriage 51 by the gap adjusting portion 57. Further, the second carriage 52 is positioned in a state of being abutted against the first guide shaft 53 on the abutting portion 52*g* and the abutting portion 52*h* such that the ink jet head 31 is restricted from being inclined to the transportation direction of the medium M with respect to the first direction.

Therefore, the inclination of the ink jet head 31 with respect to the first direction can be restricted without providing an adjusting mechanism which adjusts the inclination of the ink jet head 31. Accordingly, the number of parts from the first guide shaft 53 to the ink jet head 31 can be reduced and positional accuracy of the ink jet head 31 can be ensured. Therefore, assembling time can be reduced. This makes it possible to reduce in cost.

The technical range of the invention is not limited by the above-described embodiment and changes can be made to the above-described embodiment appropriately in the range without departing from the spirit of the invention.

For example, in the above-described embodiment, the configuration in which the bending portion 52*k* is provided on the second carriage 52 and the second abutting portion 56 is provided on the bending portion 52*k* has been described as an example. However, the invention is not limited to the configuration.

Figure 5:
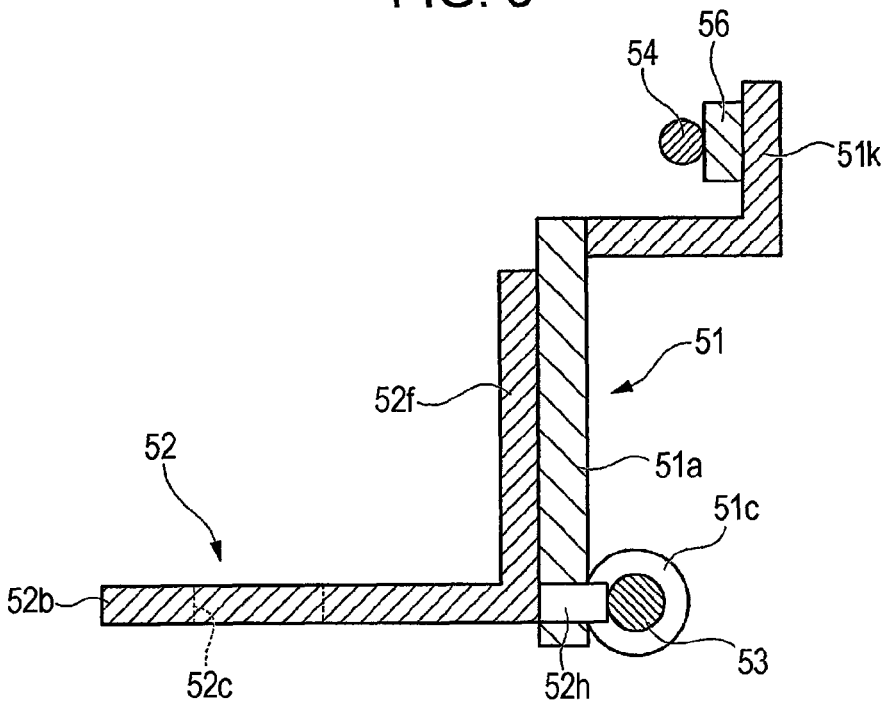
FIG. 5 is a view illustrating a variation on the printer according to the invention.

For example, as illustrated in FIG. 5, a configuration in which the bending portion 52*k* is provided on the base member 51*a* of the first carriage 51 and the second abutting portion 56 is provided on the bending portion 52*k* may be employed. Even with the configuration in which the first carriage 51 is supported on the second guide shaft 54 as described above, movement of the ink jet head 31 in the transportation direction of the medium M can be restricted.

Further, in the above-described embodiment, the configuration in which the first guide shaft 53 and the second guide shaft 54 are arranged to be aligned in the second direction has been described. However, the invention is not limited thereto.

Figure 6:
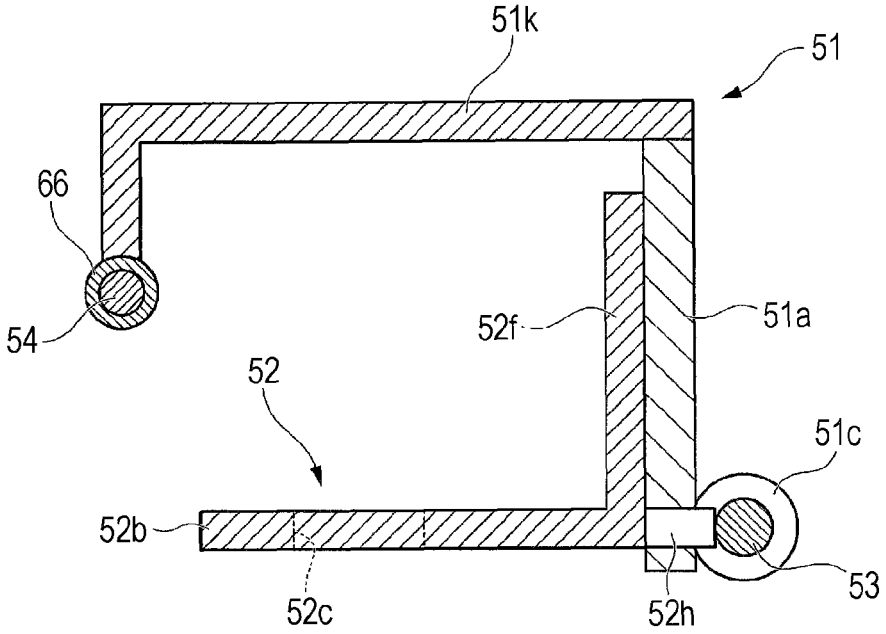
FIG. 6 is a view illustrating another variation on the printer according to the invention.

For example, as illustrated in FIG. 6, a configuration in which the first guide shaft 53 and the second guide shaft 54 are arranged at positions deviated from each other in the transportation direction of the medium M may be employed. In the configuration as illustrated in FIG. 6, a bending portion 51*k* provided on the first carriage 51 is formed in a state of extending toward the second guide shaft 54. A bearing portion 66 surrounding the outer circumferential surface of the second guide shaft 54 is provided on a tip of the bending portion 51*k*. The bearing portion 66 is movable in the first direction in a state of being supported on the second guide shaft 54.

Even with this configuration, movement of the ink jet head 31 in the transportation direction of the medium M can be also restricted. In FIG. 6, the configuration in which the bending portion 51*k* is provided on the first carriage 51 has been described as an example. However, the invention is not limited thereto. A configuration in which a bending portion is provided on the second carriage 52 may be employed.

Figure 7:
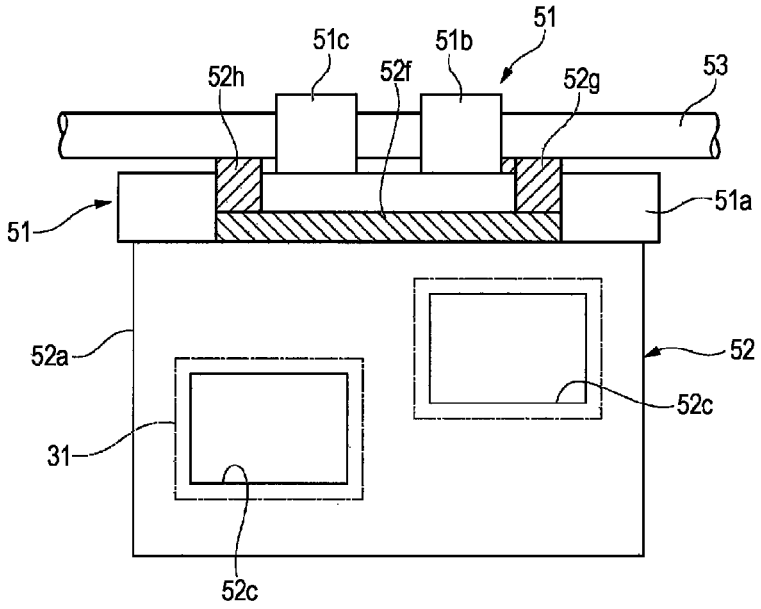
FIG. 7 is a view illustrating still another variation on the printer according to the invention.

Further, in the above-described embodiment, the configuration in which the abutting portion 52*g* and the abutting portion 52*h* provided on the second carriage 52 are arranged between the bearing portion 51*b* and the bearing portion 51*c* of the first carriage 51 in the first direction has been described as an example. However, the invention is not limited thereto. For example, as illustrated in FIG. 7, a configuration in which the bearing portion 51*b* and the bearing portion 51*c* are arranged between the abutting portion 52*g* and the abutting portion 52*h* in the first direction may be employed.

Figure 8:
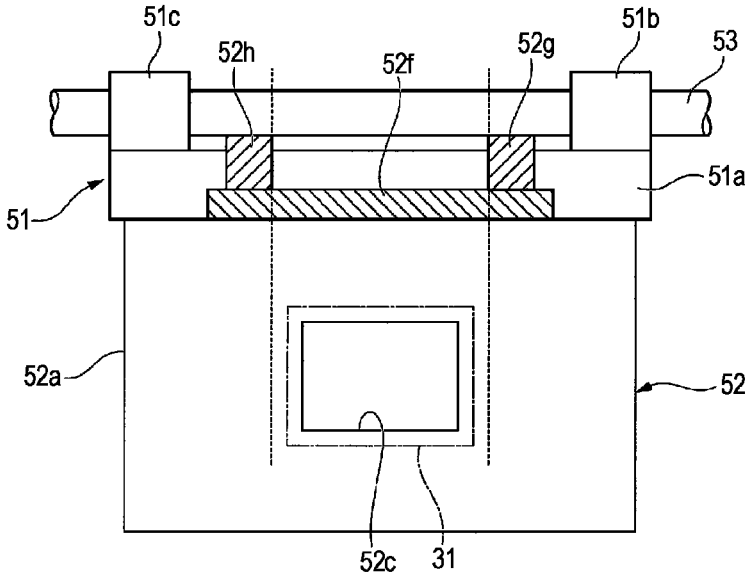
FIG. 8 is a view illustrating still another variation on the printer according to the invention.

Further, as configurations of the abutting portion 52*g* and the abutting portion 52*h*, as illustrated in FIG. 8, a configuration in which the abutting portion 52*g* and the abutting portion 52*h* are arranged so as to sandwich the ink jet head 31 arranged on the second carriage 52 in the first direction may be employed, for example. In FIG. 8, the configuration in which one ink jet head 31 is provided has been described as an example in order to make the drawing easy to be recognized. However, the invention is not limited thereto and a configuration in which equal to or more than two ink jet heads 31 are provided may be applicable.

Further, in the embodiment, a configuration in which the recording apparatus is the printer 1 has been described as an example. However, the invention is not limited thereto. The recording apparatus may be an apparatus such as a copying machine or a facsimile. Further, as the recording apparatus, recording apparatuses which eject and discharge fluids other than ink may be employed.

The invention can be applied to various types of recording apparatuses including recording heads which discharge a trace amount of liquid droplets, for example. Note that the terminology "liquid droplets" represents a state of liquid which is discharged from the above-described recording apparatus. For example, a granule form, a teardrop form, and a form that pulls tails in a string-like form therebehind are included as the liquid droplets. The terminology "liquid" here represents materials which can be ejected by the recording apparatus. For example, any materials are included as long as the materials are in a liquid phase. For example, materials in a liquid state having high viscosity or low viscosity or a fluid state such as sol, gel water, other inorganic solvents, an organic solvent, a solution, a liquid resin or a liquid metal (molten metal) can be included as the liquid. Further, the liquid is not limited to liquid as one state of a material but includes a solution, a dispersion or a mixture of particles of a functional material made of a solid material such as pigment or metal particles.

Further, ink as described in the above-described embodiment is included as a representative example of the liquid. The terminology "ink" here encompasses various liquid compositions such as common aqueous ink and oil ink, gel ink and hot melt ink. In addition, the recording medium encompasses functional paper which thermally expands to be thin, a substrate, a metal plate, and the like in addition to paper and a plastic film such as a vinyl chloride-based film.

The entire disclosure of Japanese Patent Application No. 2011-287760, filed Dec. 28, 2011 is expressly incorporated by reference herein.

What is claimed is:

1. A recording apparatus comprising:

an ejecting head that ejects fluid onto a recording medium, and a head moving portion that makes the ejecting head reciprocate in a first direction, wherein the head moving portion includes:

a guide shaft which is arranged along the first direction;

a first carriage which is supported on the guide shaft, and moves in the first direction along the guide shaft, and a second carriage, which is provided integrally with the ejecting head, is connected to the first carriage, is provided so as to be movable in a second direction in which a distance between the ejecting head and the recording medium is changed, and is positioned in a state where a part of the second carriage is abutted against the guide shaft such that inclination of the ejecting head with respect to the first direction is restricted.

2. The recording apparatus according to claim 1, wherein the head moving portion has a second guide shaft which is arranged so as to be spaced from the guide shaft and guides reciprocation of the ejecting head in the first direction.

3. The recording apparatus according to claim 2, wherein the second carriage is positioned in a state where a part of the second carriage is abutted against the second guide shaft.

4. The recording apparatus according to claim 2, wherein the first carriage is supported on the second guide shaft.

5. The recording apparatus according to claim 1, wherein the head moving portion has an elastic member that produces an elastic force in the second direction acting on the first carriage and the second carriage.

6. The recording apparatus according to claim 1, wherein the second carriage is abutted against the guide shaft at at least two places.

* * * * *